US005096131A

United States Patent [19]

Patzelt et al.

[11] Patent Number: 5,096,131

[45] Date of Patent: Mar. 17, 1992

[54] MATERIAL BED ROLLER MILL

[75] Inventors: Norbert Patzelt; Gotthardt Blasczyk, both of Beckum, Fed. Rep. of Germany

[73] Assignee: Krupp Polysius AG, Fed. Rep. of Germany

[21] Appl. No.: 484,834

[22] Filed: Feb. 26, 1990

[30] Foreign Application Priority Data

Mar. 10, 1989 [DE] Fed. Rep. of Germany ..... 3907830

[51] Int. Cl.[5] ..... B02C 4/02

[52] U.S. Cl. ..... 241/224

[58] Field of Search ..... 241/224, 225, 226, 186 P, 241/186.2

[56] References Cited

U.S. PATENT DOCUMENTS 3,174,696 3/1965 Hoffman ..... 241/224

FOREIGN PATENT DOCUMENTS 3407534 9/1985 Fed. Rep. of Germany ..... 241/224

3535406 4/1987 Fed. Rep. of Germany .

*Primary Examiner*—Mark Rosenbaum

*Attorney, Agent, or Firm*—Learman & McCulloch

[57] ABSTRACT

The invention relates to a material bed roller mill for crushing brittle material to be ground in the gap between two driven rollers which are pressed against one another with a high grinding force with a filling shaft for the delivery of material provided above the rollers. The width of the stream of material delivered to the roller gap can be altered with the aid of vertical guide walls which are adjustable at right angles to the vertical central plane of the roller mill while maintaining their vertical position. The column of material which is aligned vertically above the rollers creates pressure which is introduced fully into the material bed crushing and if required the column of material can be moved in the cross direction with respect to the rollers.

6 Claims, 2 Drawing Sheets

MATERIAL BED ROLLER MILL

Figure 1:
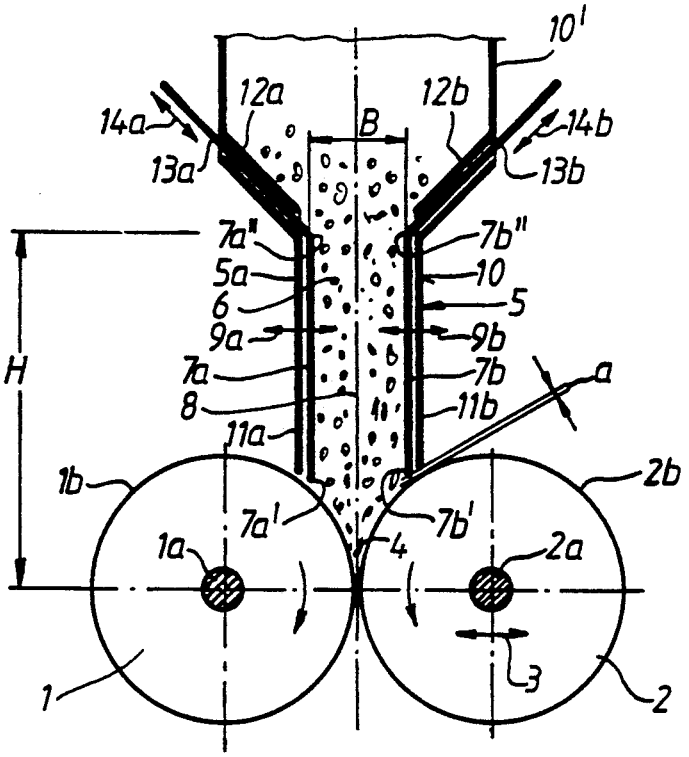

The invention relates to a material bed roller mill of the type used for grinding material fed in a stream through a pair of driven rolls.

BACKGROUND OF THE INVENTION

A material bed roller mill of the aforesaid type is known for example from DE-OS 35 35 406. In this case two opposing slide-like covers are provided at a certain height above the roller gap and at the lower end of a filling shaft. These covers are capable of being moved towards one another in a straight line in their chosen inclination in order thereby to be able to regulate the material feed width and/or the height of the material column bearing on the rollers.

The object of the invention is to improve the known material bed roller mill in such a way that with a relatively simple construction the pressure exerted by the column of material to be ground above the rollers can be utilised to the greatest possible extent for material bed crushing even with a fluctuating material feed.

SUMMARY OF THE INVENTION

In the construction according to the invention, particularly of the filling shaft, the stream of material to be ground and delivered to the roller gap is confined laterally in guide walls which are adjustable at right angles to the vertical central plane, i.e. in the cross direction with respect to the roller axes, so that in the case of both small and large quantities of material a minimum height of the column of material to be ground can be maintained. In this case it is also of great importance that the adjustable guide walls of the filling shaft retain their vertical position during their cross adjustment. In this way the pressure of material for grinding which is produced by the column of material to be ground standing above the rollers can be practically fully utilised for material bed crushing in the region of the roller gap. Thus in this construction of the guide walls the material which is streaming in or the material located in the material column has a reliable vertical lateral guiding even when the vertical guide walls of the filling shaft are adjusted in the cross direction with respect to the vertical central plane according to the quantity of material which is streaming in at any moment.

For the two vertical guide walls it can be advantageous if they are adjustable together in the cross direction with respect to the vertical central plane or are adjustable individually and independently of one another in this cross direction. Thus the column of material for grinding which is defined laterally by the vertical guide walls can be aligned symmetrically with respect to the vertical central plane of the material bed roller mill if depending upon the composition of the material to be ground the two drive motors of the two grinding rollers have the same power consumption.

If the material to be ground is of differing origin and/or of very different particle size (for example if uncrushed fresh material and returned tailings are delivered together to the filling shaft), it can happen that with symmetrical delivery of the column of material to be ground to the roller gap the two grinding rollers are differentially loaded and thus their drive motors have differing power consumptions. In this case, for example by means of cross adjustment of only one guide wall, the column of material above the roller gap can be arranged asymmetrically with respect to the vertical central plane of the roller mill so that the power consumption of the drive motors of both rollers is again equalised.

THE DRAWINGS

Figure 2:
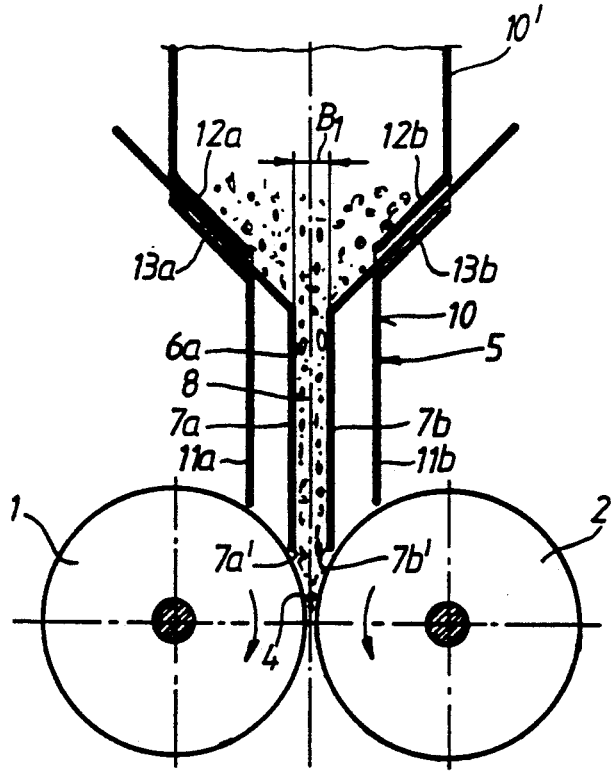
Figure 3:
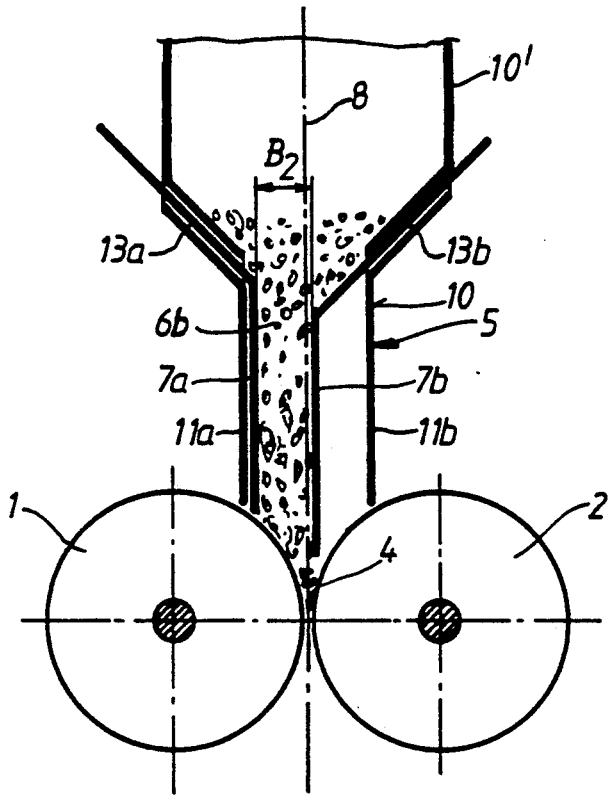

The invention will be described in greater detail below with the aid of the accompanying drawings, wherein:

FIG. 1 is a cross-sectional view of the invention showing the vertically extending guide walls disposed so as to provide the greatest internal width of the column of material to be ground;

FIG. 2 is a cross-sectional view of the invention showing the vertically extending guide walls disposed so as to provide a smaller internal width of the column of material to be ground; and FIG. 3 is a cross-sectional view of the invention showing the right-hand vertically extending guide wall moved toward the central plane of the material bed roller mill so as to present a column of material to be ground which is asymmetrical with respect to the vertical central plane of the material bed roller mill.

THE PREFERRED EMBODIMENT

The general construction of the material bed roller mill will be explained first of all with the aid of FIG. 1, although all the parts of this materials bed roller mill in all the drawings are the same so that they are all provided with the same reference numerals.

The material bed roller mill includes a driven roller means having two rollers 1, 2 which are arranged adjacent to one another and are pressed against one another with a high grinding force, of these rollers the roller 1 is constructed as a fixed roller and the roller 2 as a floating roller. The floating roller 2 is mounted so as to be movable in the direction of the double arrow 3 and thus in the direction of the fixed roller 1, as is known per se. Both rollers 1, 2 are preferably driven so that they run against one another by a separate drive motor for each roller—not shown in detail here.

Between the two rollers 1, 2 is a roller gap (grinding gap) 4, above which is arranged a filling shaft 5 for delivery of the material for grinding to the roller gap 4.

Means for adjusting the width of a stream of material (6*a*, 6*b*) is provided so that the internal width B of the stream of material delivered from the filling shaft 5 to the roller gap 4, that is to say the column of material 6 formed thereby, can be altered in any manner desired.

To this end, the means for adjusting the width of a stream of material includes two opposing vertical guide walls 7*a* and 7*b* which are spaced from one another and are located in the lower region of the filling shaft 5 so that they are adjustable at right angles to the vertical central plane 8 of the material bed roller mill whilst maintaining their vertical position. These two vertical guide walls 7*a*, 7*b* thus define the stream of material to be ground (column of material 6) which is to be delivered to the roller gap 4 in the lateral direction, i.e. in the cross direction with respect to the roller axes 1*a* or 2*a*.

The two vertical guide walls 7*a* which lie opposite one another on both sides of the vertical central plane 8 extend parallel to the roller axes 1*a*, 2*a* as well as extending over substantially the entire axial length (at right angles to the drawing plane of FIGS. 1 to 3) of the rollers 1 and 2. According to need and construction, both guide walls 7*a*, 7*b* can be adjusted in the cross direction with respect to the vertical central plane 8, i.e.

in the direction of the double arrows 9a, 9b, either together or individually and independently of one another. In this way a more or less wide column of material 6 or 6a (FIGS. 1 and 2) which is symmetrical or a column of material 6b (FIG. 3) which is asymmetrical with reference to the vertical central plane 8 of the material bed roller mill can be formed above the roller gap 4 or above the two rollers 1, 2, and maintained or set. This arrangement is generally dependent above all upon the power consumption of the two drive motors for the rollers 1 and 2 and thus upon the working load of each of these two rollers 1, 2. In each case the column of material for grinding 6, 6a, 6b is always laterally defined by vertically extending guide walls 7a, 7b so that the full pressure exerted by the column of material for grinding which stands above the rollers 1, 2 is utilised for the material bed crushing. The height H (FIG. 1) of the column of material 6, 6a, or 6b bearing upon the rollers 1, 2 or the roller gap 4 becomes effective above all for this purpose and can be held or set at its optimum height by the cross adjustment (arrows 9a, 9b) of the guide walls 7a, 7b and thus by the adjustability of the width B of the column.

This means, therefore, that the lateral cross adjustment of the vertical guide walls 7a, 7b permits a reduction of the quantity of material to be delivered without the pressure exerted by the column of material in the direction of the roller gap 4 being reduced. Each of the two vertical guide walls 7a, 7b is arranged directly above an appertaining roller 1 or 2 respectively. In this case the lower long edge 7a' or 7b' respectively of each guide wall 7a or 7b is a substantially constant minimum distance a from the outer peripheral side 1b, 2b of the appertaining roller.

In the example illustrated in the drawings, the filling shaft 5 has a main shaft body 10 which has in the lower vertical shaft section 5a two stationary shaft walls 11a, 11b which lie spaced opposite one another on both sides of the vertical central plane 8 and run parallel to the roller axes 1a, 2a. The two vertical guide walls 7a, 7b are arranged so as to be adjustable in the cross direction (arrows 9a, 9b) between these shaft walls 11a, 11b. These two stationary shaft walls 11a, 11b also end a small distance (for instance the distance a in FIG. 1) above the outer peripheral side 1b or 2b of the appertaining roller 1 or 2 respectively. The transverse distance between these two stationary shaft walls 11a, 11b is so great that the guide walls 7a, 7b which move transversely between them can be displaced to a maximum width B of the column of material (for instance the column of material 6 in FIG. 1).

The main shaft body 10 also has in the region of the upper ends 7a'', 7b'' of the vertical guide walls 7a, 7b—viewed in cross-section of the roller mill (cf. illustrations in FIGS. 1–3)—a funnel-shaped wider portion which is essentially formed by two inclined walls 12a and 12b which are preferably of equal size and are inclined downwards (converging) symmetrically with respect to the vertical central plane 8. These two inclined walls 12a, 12b for instance adjoin the upper ends of the stationary shaft walls 11a, 11b. Above the funnel-shaped wider portion which is formed in this way, the main shaft body 10 can also have a container-like upper part 10' with substantially straight side walls like a storage bunker.

Substantially flat sliding walls 13a or 13b which are each associated with one of the inclined walls 12a or 12b respectively of the main shaft body 10 are firmly, preferably rigidly connected to the upper end 7a'' or 7b'' respectively of each vertical guide wall 7a, 7b. Each of these substantially flat sliding walls 13a, 13b is preferably inclined like the inclined walls 12a, 12b. Each sliding wall 13a or 13b is guided so as to be slidably movable and adjustable in or on the appertaining inclined wall 12a or 12b respectively in the direction of the double arrows 14a, 14b. This adjustability of the two sliding walls 13a, 13b in the direction of the arrows 14a, 14b is provided in such a way that at the same time the vertical guide walls 7a or 7b which are connected to these sliding walls 13a, 13b respectively can be moved in the direction of the double arrows 9a or 9b respectively at right angles to the vertical central plane 8. It goes without saying that a suitable adjustment device which can be constructed in a manner which is known per se for slides can be associated with each sliding wall 13a, 13b, in order to be able to ensure the necessary or desired possibilities for adjustment of the vertical guide walls 7a, 7b (together or individually and independently of one another).

The sliding walls 13a, 13b described above have the advantage that they can lengthen the inclined walls 12a, 12b of the main shaft body 10 in the direction of the vertical central plane 8 as additional inclined funnel guiding for the stream of material to be delivered.

It goes without saying that if required suitable additional adjustment means can be provided on the lower end sections of the vertical guide walls 7a, 7b to provide for the maintenance of the vertical position of these guide walls 7a, 7b in this lower section too, particularly in the case of relatively large height dimensions of the vertical guide walls 7a, 7b. These additional adjustment means could advantageously be coupled to the adjustment devices for the sliding walls 13a, 13b. Naturally, other suitable means for cross adjustment of the vertical guide walls 7a, 7b could also be provided.

A comparison of the illustrations in FIGS. 1, 2 and 3 will reveal that they each merely show different adjustment positions of the vertical guide walls 7a, 7b. For instance FIG. 1 shows the greatest internal width B of the column of material 6 with the vertical guide walls 7a and 7b practically moved fully outwards. Thus according to FIG. 1 a column of material 6 is produced which is symmetrical with respect to the vertical central plane 8 of the material bed roller mill or with respect to the roller gap 4 and has a maximum width B.

According to FIG. 2 the two vertical guide walls 7a and 7b are moved by the same distance towards the vertical central plane 8, so that a column of material 6a is produced which is again symmetrical with respect to the vertical central plane 8 but of relatively smaller width $B_1$.

According to the illustration in FIG. 3, only the right-hand vertical guide wall 7b is moved almost completely towards the vertical central plane 8 of the material bed roller mill, whilst the left-hand vertical guide wall 7a remains set in its outermost position near the shaft wall 8a (for instance as in FIG. 1). In this way a column of material 6b is formed which is asymmetrical with respect to the vertical central plane 8 and to the roller gap 4 and has a corresponding width $B_2$.

It can be seen from a comparison of FIGS. 1, 2 and 3 that any selected one of a number of settings and alignments of the column of material to be delivered to the roller gap 4 is possible. The asymmetrical delivery of the stream of material to the roller gap 4 is chosen above all on a correspondingly large scale when the power consumption of the drive motor of one roller is higher than that of the other roller, so that as a result of this asymmetrical arrangement the stream of material can be guided more strongly onto the outer peripheral side of one roller in such a way that the power consumption of the drive motors is the same for both rollers.

Finally, it should be mentioned that with the guide walls *7a*, *7b* of the filling shaft 5 always vertical the highest throughput of this material bed roller mill is achieved if the internal shaft width B (and thus the width B of the column of material), the height H of the material and the diameter of the rollers 1, 2 are coordinated with one another in a suitable ratio.

For the sake of completeness it should also be mentioned that end walls which are known per se and of course constructed and mounted in any suitable manner can be provided in the region of the end faces of the filling shaft 5, i.e. in the region of the axial ends of the pair of rollers 1, 2, and there these end walls define the column of material.

We claim:

1. A material bed roller mill comprising driven rollers rotatable about parallel axes for grinding a material, said rollers forming a roller gap extending longitudinally of said axes; a filling shaft disposed above said roller gap defining a vertical central plane parallel to said axes and for delivering the material in a stream to the roller gap; means for adjusting the width of the stream of said material transversely of said roller gap, said adjusting means comprising vertically extending guide walls in said filling shaft with each guide wall disposed above a respective one of the driven rollers substantially parallel to its axis and along substantially its entire axial length, said guide walls defining therebetween an upstanding material flow passage having a substantially constant width in the vertical direction and through which passage said stream of material may flow; and means for moving at least one of said guide walls toward and away from said central plane to adjust the width of the material flow passage from a first selected constant width to another selected constant width so as to thereby adjust the width of said stream of material between said guide walls, each of said vertically extending guide walls having a lower long edge and being simultaneously movable vertically and horizontally relative to the axes of rotation of the underlying rollers for providing adjustment in spacing between said guide walls while maintaining a substantially constant width gap between said long edge of each of said guide walls and the periphery of the associated underlying roller.

2. A material bed roller mill as set forth in claim 1 further characterized in that said rollers are biased against one another under force, at least one of said rollers (1, 2) being movable in the direction of the other of said rollers (1, 2).

3. Material bed roller mill as claimed in claim 1, further characterised in that said vertically extending guide walls (*7a*, *7b*) are adjustable simultaneously.

4. Material bed roller mill as claimed in claim 1, further characterised in that said vertically extending guide walls (*7a*, *7b*) are adjustable individually and independently of one another with respect to said vertical central plane (8).

5. Material bed roller mill as claimed in claim 1, further characterised in that the filling shaft (5) has a main shaft body (10) with two stationary shaft walls (11*a*, 11*b*) which lie opposite one another and run parallel to said roller axes (1*a*, 2*a*), said guide walls (*7a*, *7b*) being arranged so as to be adjustable toward and away from said shaft walls (11*a*, 11*b*).

6. Material bed roller mill as claimed in claim 5 further characterised in that the said guide walls (*7a*, *7b*) include upper ends (*7a*'', *7b*'') respectively, and wherein said main shaft body (10) has in the region of said upper ends (*7a*'', *7b*'') of the vertical guide walls (*7a*, *7b*) a funnel-shaped wider portion with two inclined walls (12*a*, 12*b*) which are of substantially equal size and are inclined downwards symmetrically with respecst to said vertical central plane (8), and wherein in each of said inclined walls (12*a*, 12*b*) is a substantially flat sliding wall (13*a*, 13*b*) which is similarly inclined and guided so as to be slidably movable, each of the said flat sliding walls (13*a*, 13*b*) being connected to said upper end (*7a*'', *7b*'') of one of the vertical guide walls (*7a*, *7b*) respectively, so that a sliding movement of said sliding walls (13*a*, 13*b*) adjusts said guide walls (*7a*, *7b*).

* * * * *

UNITED STATES PATENT AND TRADEMARK OFFICE

CERTIFICATE OF CORRECTION

PATENT NO. : 5,096,131

DATED : March 17, 1992

INVENTOR(S) : Norbert Patzelt and Gotthardt Blasczyk

It is certified that error appears in the above-identified patent and that said Letters Patent is hereby corrected as shown below:

Column 2, line 28, change "materials" to

-- material --.

Signed and Sealed this

Nineteenth Day of October, 1993

Bruce Lehman

*Attest:*

BRUCE LEHMAN

*Attesting Officer*

*Commissioner of Patents and Trademarks*